United States Patent [19]

Waldhauser

[11] Patent Number: 5,046,973

[45] Date of Patent: Sep. 10, 1991

[54] BOAT PROPELLER

[76] Inventor: Kurt Waldhauser, Hans-Friz-Weg 28, Graz, Austria, A-8010

[21] Appl. No.: 353,654

[22] PCT Filed: Oct. 9, 1987

[86] PCT No.: PCT/AT87/00056

§ 371 Date: Apr. 5, 1989

§ 102(e) Date: Apr. 5, 1989

[87] PCT Pub. No.: WO88/02719

PCT Pub. Date: Apr. 21, 1988

[30] Foreign Application Priority Data

Oct. 9, 1986 [AT] Austria ..... 2684/86

[51] Int. Cl.[5] ..... B63H 3/00

[52] U.S. Cl. ..... 440/50; 416/147

[58] Field of Search ..... 440/50; 416/145, 147, 416/157, 160

[56] References Cited

U.S. PATENT DOCUMENTS 1,740,077 12/1929 Dumbleton ..... 416/147

3,092,186 6/1963 MacLean ..... 440/50

*Primary Examiner*—Jesus D. Sotelo

*Attorney, Agent, or Firm*—Townsend and Townsend

[57] ABSTRACT

A ship propeller arrangement (1), in particular for motor boats, has a propeller being operated with supercavitative rotating speed and having its propeller blades (5) provided with step bearings (7) being swivelable around threaded bolts (6), which are screwed into a propeller star (8) being put onto the propelling shaft (2). Rotation of each propeller blade (5) is effected by a hollow shaft (17) surrounding the propelling shaft (2) and by bevel gears (14, 15) being put onto the hollow shaft as well as onto the propelling shaft and being in meshing engagement with a cogging (12) of the respective step bearing (7). For the purpose of limiting the forces acting in radial direction, the outer surface of each step bearing (7) is kept free. The step bearing (7) is held in radial direction by a shoulder (9) of the threaded bolt (6) (FIG. 2).

8 Claims, 1 Drawing Sheet

BOAT PROPELLER

The invention refers to a ship propeller, in particular for motor boats, comprising at least two propeller blades. Each blade of which is mounted for being swivelable around an axis oriented in normal direction to the axis of the propelling shaft on a propeller star put onto the propelling shaft. For the purpose of effecting such swivelling movement there is provided an adjusting drive means guided along the propelling shaft. Each propeller blade carries a step bearing rotatably supported on the propeller star by means of a bolt extending in normal relation relative to the axis of the propelling shaft and that the propeller blade is connected with a cogging being in meshing engagement with a cogging of the adjusting drive means.

Marine propulsions are most frequently designed as submarine propellers. There are used, with consideration of effectivity and of economy, for bigger ships propeller arrangements operated with sub-cavitative rotating speed, i.e. with a rotating speed being geared down for a multiple relative to the motor speed. On the other hand, there are known for rapid racing boats, high-strength racing propellers of great pitch and small diameter and being frequently operated as surface propellers with the speed of the motor speed, which means that they rotate with super-cavitative speed. In this case, optimum operation of such a surface propeller is obtained if it extends below the water surface for half of its diameter.

For various reasons, it is frequently desired to be in the position to adjust the propeller blades. This is not accompanied by difficulties in case of ship propellers being operated with sub-cavitative speed. For this purpose, there is provided an adjusting propeller hub comprising a bipartite housing enclosing the adjusting mechanism and having a relatively great diameter on account of the necessity to bearingly support the propeller blades and to accommodate therein the propeller adjusting pinions and the toothed racks being in meshing engagement therewith. Thus, it becomes impossible to use the known adjusting propeller constructions for surface propellers, because the centrifugal forces would become too great on account of the high rotating speed of these propellers. This equally applies for a ship propeller arrangement of the initially described type U.S. application Ser. No. 2 715 446) in which the propeller star carries radial bolts, each of which forms a centering means for its propeller blade being in its interior connected in a non-rotatable manner with a bevel gear. A housing portion holding in position the propeller blade against the radially acting centrifugal forces extends between the step bearing and said bevel gear. Such a construction can not be used for ship propellers being operated with super-cavitative speed.

It is an object of the invention to avoid these drawbacks in such a manner that an adjusting propeller construction can be operated as surface propeller, i.e. with super-cavitative speed (motor speed). This task is, according to the invention, solved by the fact that the step bearing is fixed on the propeller star by the bolt in a tension-transmitting manner and that the step bearing carrying the cogging has its outer surface substantially exposed. In this manner, each bolt fulfills the role which has been fulfilled by the housing of the previously described known construction, so that this housing is omitted and the outer surface of the step bearing is thus substantially exposed. Thus, there results a compact construction, i.e. a construction in which all component parts required for adjusting the propeller blades are located as near as possible in proximity of the axis of the drive shaft, which results as compared with the known construction in a reduction of the centrifugal forces. On account thereof, it becomes possible to operate the construction according to the invention with such a high speed that its use as a surface propeller is possible.

In principle, it would be conceivable to provide the bolt at its both ends with one shoulder each, which provides the tension transmitting connection between propeller blade and propeller star. It is, however, much more favourable and simple if each bolt is a threaded bolt being screwed into a female thread of the propeller star. To be in the position to make the length of the thread, which has to receive the radially acting tension forces, as long as possible, each step bearing has, according to the invention, at its inner side a conical surface, by means of which it is supported on a conical surface of the propeller star. This not only results in automatically centering the step bearing on the propeller star but also in the advantage that the circumferential portion of the step bearings and the portions of the propeller star located radially remote from the threaded bolt are brought in closer proximity to the propelling shaft so that the centrifugal forces are reduced. For the latter reason it is also convenient if, according to the invention, each bolt has at its outer end a shoulder being countersunk in a recess of the outer surface of the step bearing. This simultaneously results in reliably maintaining in position the step bearing and in a great bearing surface for rotating the step bearing relative to the bolt when adjusting the propeller blade. By suitably selecting the shape and the material of the bolt, maximum admissible centrifugal forces of the propeller can be resisted.

According to the invention, each step bearing carries on its circumference the cogging, which cooperates with the cogging of the adjusting drive means. The construction according to the invention provides thus the possibility to give the coggings of the adjusting drive means cooperating with the coggings of the step bearings maximum dimensions, because the step bearings must not be below a minimum thickness required for receiving the bolts or, respectively, the shoulders thereof.

For the purpose of equalizing the centrifugal forces acting in radial direction and for the purpose of reducing the flow resistance, the outer surfaces of the step bearings are, according to the invention, given a spherical shape, noting that the shoulder of each bolt is preferably located with its outer surface within this spherical surface. Thus, each step bearing forms with its outer surface a spherical segment, the diameter of which, which is given the maximum possible size, is limited by the circumstance that the spherical segments must not come in mutual contact during the adjusting movement. Within the spirit of the invention, only such clearance of motion is admitted between the coggings of the spherical segments formed by the step bearings of the propeller blades as is required for the mentioned adjusting movement, but the space being at disposal is completely utilized on account of strength considerations.

For the purpose of reliably receiving the centrifugal forces, the threaded bolts must not only be strongly dimensioned with respect to their diameters, but must also have long threads. According to a preferred ambodiment of the invention, the threaded bolts extend thus to the driving shaft. For the purpose of preventing any unintended loosening of the threaded bolts, the threaded bolts are secured in position by fixing screws in the propeller star.

Further features and advantages of the invention can be derived from the description of an example of embodiment being schematically shown in the drawings.

Figure 1:
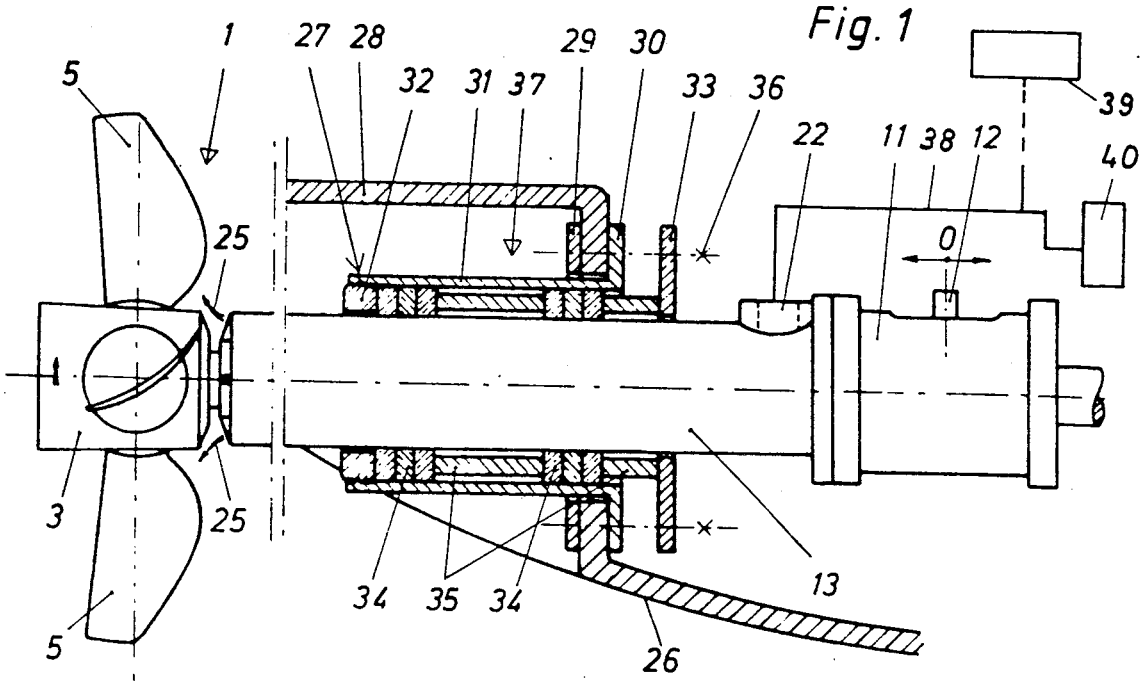
FIG. 1 shows in a side elevation and partially in a section an adjusting mechanism for a surface propeller.
Figure 2:
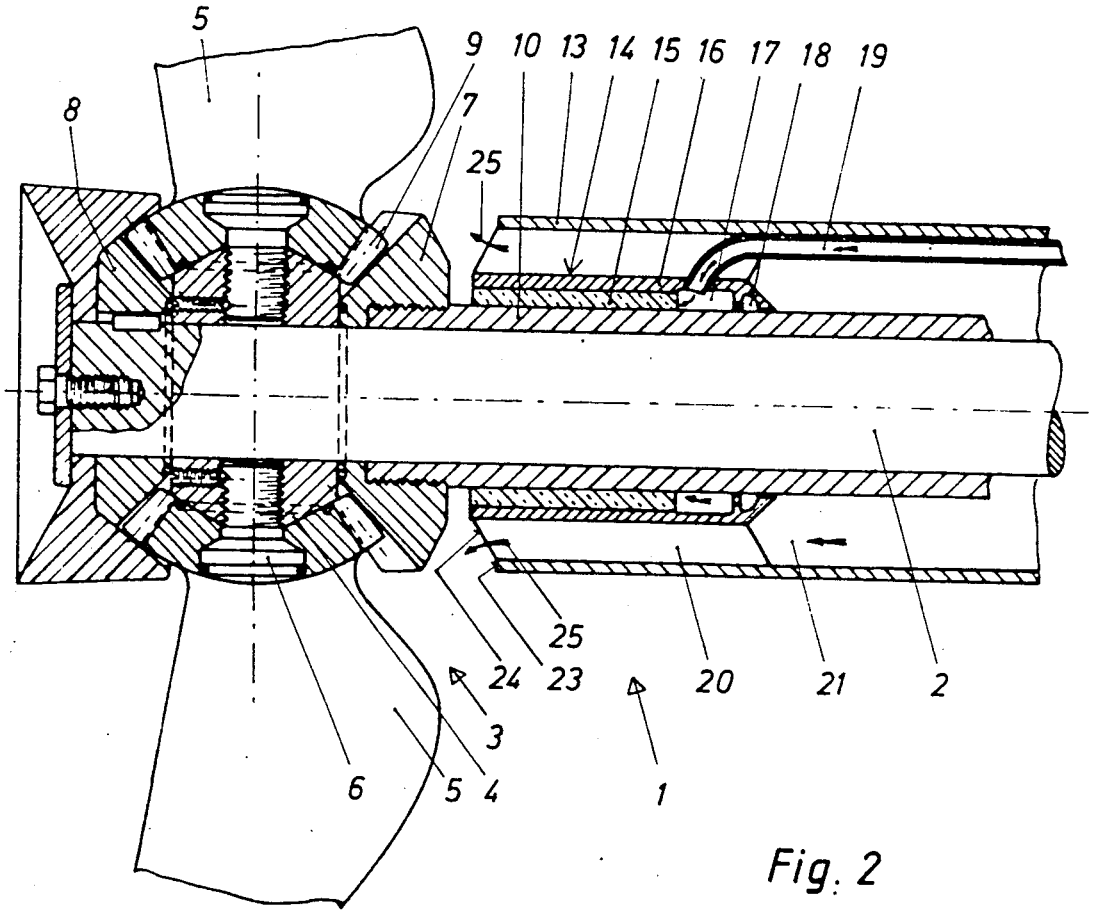
FIG. 2 shows a vertical section through the propeller hub in a greater scale.

The propeller arrangement 1 is driven via a drive shaft 2 being designed as a solid shaft and being bearingly supported within a stem tube 3. A propeller hub 4 carrying the propeller blades 5, four blades in the embodiment shown, is seated on the drive shaft 2. The propeller hub 4 has no outer shell receiving the centrifugal forces exerted by the propeller blades 5, but, to the contrary, all components of the drive means required for adjusting the propeller blades 5 are arranged for immediately surrounding the drive shaft 2, so that the diameter of the hub 4 can be kept very small for the purpose of reducing the centrifugal forces. The propeller blades are fixed in position by means of high-strength threaded bolts 6, which extend through step bearings 7 being integral with the propeller blades 5 and which are screwed with long threads into a propeller star 8 comprising a central bearing and centering block being rotatably put onto the drive shaft 2. Conveniently, these threads extend to the shaft 2 or to proximity thereof. Each threaded bolt 6 has at its outer end a shoulder 9 of enlarged diameter, said shoulder being seated within a recess 10 of the step bearing 7 such that it is flush with the outer surface 11 of the step bearing 7 and forms therewith a spherical surface (spherical segment). Each threaded bolt is secured in position by a fixing screw 34 being screwed into the propeller star 8 from its rear side. The step bearings 7 simultaneously form the adjusting pinions for the propeller blades 5 connected with said step bearings for swivelling the propeller blades around the respective axis of the bolts 6. For this purpose, there is provided on the circumference of each step bearing 7 a cogging 12 cooperating with a cogging 13 of two bevel gears 14, 15. The bevel gear 15 located adjacent the free end of the drive shaft 2 is non-rotatably connected with the drive shaft 2 by means of a wedge 16, whereas the other bevel gear 14 is non-rotatably mounted by means of a thread 36 on a hollow shaft 17 surrounding the drive shaft 2 and is centered by means of a bushing 18. When relatively rotating the drive shaft 2 with respect to the hollow shaft 17, there results, in this manner, synchronous rotation of all propeller blades 5. For the purpose of increasing the effective length of the thread of the threaded bolts 6, the propeller star 8 carries for each propeller blade 5 an outwardly extending protrusion 19 being lathed at its outer front surface to the shape of a conical surface 20 on which is seated an equally shaped conical surface of the step bearing 7. This simultaneously results in centering the respective step bearing 7 on the propeller star 8. This results in a centered and tilting-stable support for each propeller blade 5 and being capable to resist maximum centrifugal forces acting in longitudinal direction of the respective bolt 6 as well as to the tilting moment exerted by the propeller thrust. On account of an outer mantle being omitted, the step bearings 7 can be given a maximum size and the adjusting cogging is provided on the maximum possible outer diameter of the propeller hub 4 being formed of the component parts 6,7,8,14,15, so that said cogging can be given a sturdy size. The adjusting cogging is flown around by water which is, however, of no importance on account of the small adjusting movement being effected only in rare cases.

A restoring ring 21 can be seated on the free end of the drive shaft 2, said ring being held in position by a disc 22 and a screw 23. After loosening the screw 23, the component parts 21,15 and 8 can, together with the component parts 5,6,7, be pulled off the shaft 2 in rearward direction. All component parts being moved during the adjusting movement of the propeller are sealed with respect to water by sealing elements, preferably 0-rings 24, so that leakage of the gearing oil used for lubricating the whole propeller head and being circulated between the drive shaft 2 and the hollow shaft 17 is prevented.

Immediately adjacent the propeller hub 4, there is provided for receiving the radial forces exerted of both shafts 2,17 a rubber bearing 25 being lubricated with water supplied via a conduit 35. The rubber bearing 25 is seated within a supporting tube 26 being maintained in position within the stem tube 3 by means of supporting ribs 27. Interstices are existing between the supporting ribs 27 and are in connection with the annular space located between hollow shaft 17 and stem tube 3, said interstices providing the possibility to supply, for the purpose of improving the effectivity of the propeller mechanism 1, in direction of the arrows 31 to the suction side of the propeller blades 5 effluent gases of the motor, cooling water for the motor and optionally also pressurized air, which are introduced into the stem tube 3 via a connecting piece 28 (FIG. 1). The stem tube 3 is adjustably held within the boat hull 29 for axial adjustment by means of a packing box 30 and carries within the interior of the boat the adjusting drive means 32 for the relative rotation between hollow shaft 17 and driving shaft 2 for the purpose of adjusting the position of the propeller blades. The adjusting drive means 32 is preferably of mechanical design and has an actuating handle 33.

I claim:

1. A high speed ship propeller comprising:

a propeller shaft having a longitudinal axis;

a central bearing and centering block coupled to said propeller shaft for common rotation therewith and having a first conical bearing surface and a threaded bore;

at least two propeller blades, each of said propeller blades having (i) a socket means having a second conical bearing surface engageable with said first conical bearing surface for bearing said propeller blade on said central bearing and centering block;

(ii) wherein said socket means has a rounded outer surface such that a periphery of said outer surface is disposed nearer said propeller shaft than is a center portion of said rounded outer surface and wherein said rounded outer surface is substantially exposed to a fluid surrounding said propeller blade;

(iii) a first cogging;

(iv) a threaded bolt to couple said propeller blade to said central bearing and centering block and extending perpendicularly to said longitudinal axis of said propeller shaft, penetrating through said second conical surface, and threaded into said threaded bore of said central bearing and centering block, wherein a shoulder of each of said threaded bolts is flush with the rounded outer surface of said socket means; and a drive means having a second cogging engageable with said first cogging of said propeller blade, for swivelling said propeller blade around a longitudinal axis of said bolt and wherein said longitudinal axis of said bolt is perpendicular to said longitudinal axis of said propeller shaft.

2. The high speed ship propeller according to claim 1, wherein each of said bolts has a shoulder, located at an outer end of said bolt, countersunk within a recess of the rounded outer surface of said socket means.

3. The high speed ship propeller Ser. No. 07/353,654 according to claim 1, wherein the first cogging is located on a circumference of said socket means.

4. The high speed ship propeller according to claim 3, wherein the drive means further comprise bevel gears non-rotatably mounted onto the propeller shaft and onto a hollow shaft surrounding said propeller shaft, and wherein said second cogging is provided on said bevel gears.

5. The high speed ship propeller according to claim 1 wherein the rounded outer surface of each socket means has a spherical shape.

6. The high speed ship propeller according to claim 1 wherein the threaded bolts extend substantially to the propeller shaft.

7. The high speed ship propeller according to claim 1, wherein each of said threaded bolts are secured to said central bearing and centering block by a fixing screw.

8. The high speed ship propeller according to claim 1 wherein the drive means further comprises a plurality of sealing elements to seal a restoring ring, said bevel gear, said central bearing and centering block, said propeller blades, said threaded bolts and said socket means, actuated by said drive means, from a remaining set of components not moved by said drive means.

* * * * *